US008862045B2

(12) United States Patent
Miyake

(10) Patent No.: US 8,862,045 B2
(45) Date of Patent: Oct. 14, 2014

(54) CONVEYOR AND IMAGE FORMING APPARATUS WITH THE CONVEYOR

(75) Inventor: Yasuhiro Miyake, Osaka (JP)

(73) Assignee: Kyocera Mita Corporation, Osaka-shi (JP)

( * ) Notice: Subject to any disclaimer, the term of this patent is extended or adjusted under 35 U.S.C. 154(b) by 218 days.

(21) Appl. No.: 12/816,011

(22) Filed: Jun. 15, 2010

(65) Prior Publication Data

US 2010/0322691 A1 Dec. 23, 2010

(30) Foreign Application Priority Data

Jun. 18, 2009 (JP) ..... 2009-145389

(51) Int. Cl.

| | |
|---|---|
| ***B65H 15/00*** | (2006.01) |
| ***B65H 85/00*** | (2006.01) |
| ***B65H 5/06*** | (2006.01) |
| ***G03G 15/23*** | (2006.01) |

(52) U.S. Cl.

CPC ..... *G03G 15/238* (2013.01); *B65H 2601/272* (2013.01); *B65H 5/062* (2013.01); *G03G 2215/0043* (2013.01); *B65H 2404/14* (2013.01); *B65H 2801/06* (2013.01)

USPC ..... 399/395; 399/401

(58) Field of Classification Search

USPC ..... 399/401, 388, 395, 397, 394; 400/579; 271/902

See application file for complete search history.

(56) References Cited

U.S. PATENT DOCUMENTS

| | | | | |
|---|---|---|---|---|
| 6,173,952 | B1 * | 1/2001 | Richards et al. | 271/228 |
| 2001/0031161 | A1 * | 10/2001 | Nakazato | 399/388 |
| 2005/0254871 | A1 * | 11/2005 | Kim | 399/401 |
| 2007/0154238 | A1 * | 7/2007 | Yokoi | 399/124 |

FOREIGN PATENT DOCUMENTS

| | | | | |
|---|---|---|---|---|
| JP | 07061672 | * | 3/1995 | B65H 29/22 |
| JP | 8-188318 | | 7/1996 | |
| JP | 2002137843 | * | 5/2002 | B65H 5/06 |
| JP | 2003-95477 | | 4/2003 | |
| JP | 2003155146 | * | 5/2003 | B65H 9/00 |
| JP | 2005231836 | * | 9/2005 | B65H 9/00 |

OTHER PUBLICATIONS

JP 2002137843 machine translation.*
JP 07061672 machine translation.*

* cited by examiner

*Primary Examiner* — Matthew G Marini
*Assistant Examiner* — Ruben Parco, Jr.
(74) *Attorney, Agent, or Firm* — Gerald E. Hespos; Michael J. Porco; Matthew T. Hespos

(57) ABSTRACT

A conveyor has a first conveying unit including a pair of first nip roll sets configured to nip and convey the sheet, and a second conveying unit including a second nip roll set configured to nip and convey the sheet from the first conveying unit. The second nip roll set nips the sheet at an inner location than the first nip roll set, and the first nip roll set nips the sheet more strongly than the second nip roll set.

8 Claims, 10 Drawing Sheets

CONVEYOR AND IMAGE FORMING APPARATUS WITH THE CONVEYOR

BACKGROUND OF THE INVENTION

1. Field of the Invention

The present invention relates to a conveyor configured to convey a sheet and to an image forming apparatus with the conveyor.

2. Description of the Related Art

An image is formed on a surface of a sheet conveyed inside an image forming apparatus such as a copier, a printer, and a facsimile device. When the image forming apparatus forms the image on the sheet under improper conveyance, in which, for example, the sheet obliquely runs with respect to a base conveyor line, the image will be tilted in the sheet.

Some image forming apparatus automatically forms images on both sides of a sheet and then discharges the sheet to the outside after a user selects a two-side printing mode. The image forming apparatus with the two-side mode printing function typically comprises a system to switch back the sheet after the image is formed on either side of the sheet.

The switch-back system switching the conveyance direction of the sheet from one direction to the other direction after temporary stop is one of the most difficult techniques for conveying the sheet in the image forming apparatus. Accordingly, there are various improvements for a conveyance mechanism configured to switch back a sheet.

The complicated system for switching back the sheet causes various problems such as the oblique feed of the sheet after the switch back operation. There are several known approaches to an increase in printing efficiency (productivity) of the image forming apparatus with the switchback function by improving switchback conveyance for the sheet, but no approach addresses resolving the oblique feed of the sheet after the switchback operation.

SUMMARY OF THE INVENTION

The present invention aims to resolve the above-described conventional problem and to provide a conveyor and an image forming apparatus which hardly cause the skew (oblique feed) of the conveyed sheet.

A conveyor according to one aspect of the present invention includes a first conveying unit including a pair of first nip roll sets configured to nip and convey the sheet, and a second conveying unit including a second nip roll set configured to nip and convey the sheet from the first conveying unit, wherein the second nip roll set nips the sheet at an inner location of the sheet than the first nip roll set, and the first nip roll set nips the sheet more strongly than the second nip roll set.

An image forming apparatus according to another aspect of the present invention includes a resist roller configured to send a sheet including a first surface and a second surface opposite to the first surface downstream at a predetermined timing, a transfer unit configured to transfer a toner image onto the first surface of the sheet sent from the resist roller, a fixing unit configured to fix the toner image formed on the first surface of the sheet sent from the transfer unit, and the aforementioned conveyor; wherein the first conveying unit is configured to convey the sheet sent from the fixing unit in a discharge direction to discharge the sheet or in a duplexing direction to send the sheet to a conveying path for transferring and fixing a toner image on the second surface; and the second conveying unit is provided in the conveying path.

DESCRIPTION OF THE PREFERRED EMBODIMENTS

An embodiment of the present invention will be described below with reference to the accompanying drawings. The terms representing the directions such as "up", "down" "left", "right" in the description below merely intend to clarify the description without any limitation on the present invention. Further, in the description below, the term "transverse direction of the sheet" means a direction perpendicular to the conveying direction of the sheet. Further, in the description below, the term "inward of the sheet" means a position or a region closer to the central position in the transverse direction of the sheet.

Figure 1B:
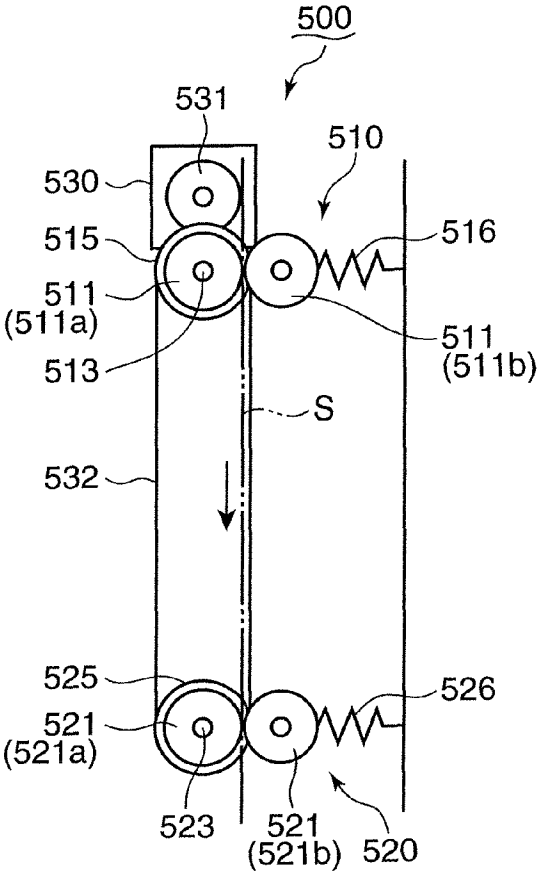
FIG. 1B is a model drawing (side view) schematically illustrating the conveyor according to one embodiment of the present invention.
Figure 1A:
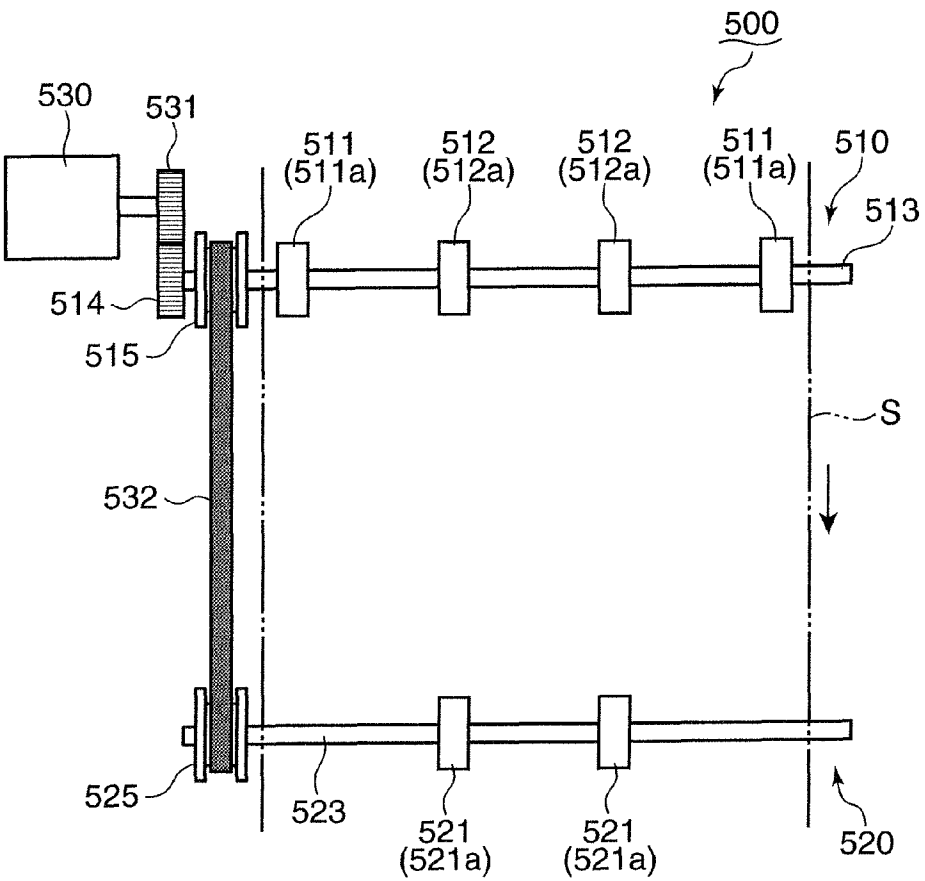
FIG. 1A is a model drawing (plan view) schematically illustrating the conveyor according to one embodiment of the present invention.

FIG. 1A and FIG. 1B are model drawings schematically illustrating the conveyor according to one embodiment of the present invention. FIG. 1A is a plan view of the conveyor, and FIG. 1B is a side view of the conveyor. The models represented in FIG. 1A and FIG. 1B schematically illustrate a structure of the conveyor configured to convey a sheet. In another embodiment, the conveyor may have a structure different from the model shown in FIG. 1A and FIG. 1B.

The conveyor 500 shown in FIG. 1A and FIG. 1B is provided with a first conveying unit 510 and a second conveying unit 520. In FIG. 1A and FIG. 1B, the sheet S to be conveyed is shown by a dash line. The conveying direction of the sheet S is shown by arrows in FIG. 1A and FIG. 1B. In the conveying direction of the sheet S, the first conveying unit 510 is disposed on the upstream side while the second conveying unit 520 is disposed on the downstream side. The first conveying unit 510 and the second conveying unit 520 convey the sheet S while nipping the sheet S with a plurality of rolls.

The first conveying unit 510 is provided with four roll sets. The roll sets in vicinity to both edges of the sheet S parallel to the conveying direction are first nip roll sets 511. The roll set between the left and right first nip roll sets 511 is a third nip roll set 512. In FIG. 1A, two third nip roll sets 512 are shown, but the number of third nip roll sets 512 is not particularly limited. Thus, one third nip roll set 512 may be used. Alternatively three or more third nip rolls 512 may be used. Further, the first nip roll set 511 may be disposed just on the edge of the sheet S parallel to the conveying direction.

The nip roll sets 511, 512 include a drive roll (first roll) 511*a* and a drive roll (second roll) 512*a* in contact with the upper surface of the conveyed sheet S. A first shaft 513 extending in the direction perpendicular to the conveying direction of the sheet S connects the drive rolls 511*a*, 512*a* together. In the model shown in FIG. 1A and FIG. 1B, a gear 514 is mounted on one end of the shaft 513. The gear 514 engages with a gear 531 mounted on a rotation shaft of a motor 530 as a drive source. In a specific embodiment, the motor 530 may bi-directionally rotate. A pulley 515 is disposed between the left first nip roll set 511 and the gear 514. The other end of the shaft 513 is rotatably supported by a bearing so that it may be appropriately mounted on a housing or a wall of any apparatus in which the conveyor 500 is incorporated although they are not shown in FIG. 1A and FIG. 1B.

The second conveying unit 520 is provided with a second nip roll set 521. The position of the second nip roll set 521 in the transverse direction of the sheet S is not particularly limited, but the second nip roll set 521 may be preferably installed in a position closer to the central portion of the conveyed sheet S in the transverse direction than the upstream first nip roll set 511. In the model shown in FIG. 1A and FIG. 1B, the position of the second nip roll set 521 of the second conveying unit 520 matches with a downstream position of the third nip roll set 512. Further, the number of the second nip roll sets 521 of the second conveying unit 520 is not particularly limited. Thus, the second conveying unit 520 may include only one nip roll set. Alternatively the second conveying unit 520 may include three or more nip roll sets. In the mode shown in FIG. 1A and FIG. 1B, the number of the third nip roll sets 512 of the first conveying unit 510 is equal to the number of the second nip roll sets 521 of the second conveying unit 520, but if necessary, the number of the second nip roll sets 521 of the second conveying unit 520 may be different from that of the third nip roll sets 512 in the first conveying unit 510.

The second nip roll set 521 of the second conveying unit 520 includes drive rolls (fifth rolls) 521*a* in contact with the upper surface of the conveyed sheet S. A shaft 523 connects the drive rolls 521*a* together. A pulley 525 is mounted on one end of the shaft 523. The other end of the shaft 523 is rotatably supported by a bearing so that it may be appropriately mounted on a housing or a wall of any apparatus in which the conveyor 500 is incorporated although they are not shown in FIG. 1A and FIG. 1B.

The pulley 515 of the first conveying unit 510 and the pulley 525 of the second conveying unit 520 are connected with a belt 532. The drive force from the motor 530 is transmitted to the driver rolls 511*a*, 512*a* by the gears 531, 514 via the shaft 513 of the first conveying unit 510. The drive force from the motor 530 is further transmitted to the second conveying unit 520 via the belt 532. Then, the drive force from the motor 530 is transmitted to the drive rolls 521*a* via the shaft 523 of the second conveying unit 520. The feed rate of the sheet S by the first conveying unit 510 and the second conveying unit 520 may be appropriately determined by a pulley ratio between the pulleys 515, 525 and/or diameters of the drive rolls 511*a*, 512*a*, 521*a*. In a specific embodiment, the feed rate of the sheet S by the first conveying unit 510 may be 239.87 mm/sec while the feed rate of the sheet S by the second conveying unit 520 may be 237.64 mm/sec. In the model shown in FIG. 1A and FIG. 1B, the power from the motor 530 is transmitted with the belt 532 to the second conveying unit 520. Alternatively in another specific embodiment, the second conveying unit 520 disconnected from the motor 530 may include the rolls 521*a*, 521*b* rotating with a friction force between their circumferential surface and the surface of the sheet S.

The lower surface of the conveyed sheet S is supported by idle rolls (third roll) 511*b* in the first nip roll set 511 of the first conveying unit 510, idle rolls (fourth roll) 512*b* in the third nip roll set 512 of the first conveying unit 510 and idle rolls (sixth roll) 521*b* in the second nip roll set of the second conveying unit 520. The idle rolls 511*b*, 512*b*, 521*b* are rotatably mounted on a case or a wall of any apparatus in which the conveyor 500 is incorporated with an appropriate method. The idle rolls 511*b*, 512*b*, 521*b* are rotated with an friction force between their circumferential surfaces and the lower surface of the sheet S conveyed downstream by the rotation of the drive rolls 511*a*, 512*a*, 521*a*.

The idle rolls 511*b*, 512*b*, 521*b* may be supported by elastic bodies 516, 526 such as plate springs, rod springs, and coil springs. In a specific embodiment, the elastic bodies 516, 526 rotatably support the idle rolls 511*b*, 512*b*, 521*b* with connecting them to a case or a wall of any apparatus in which the conveyor 500 is incorporated. The elastic bodies 516, 526 generate a nip force (compression force to the sheet S) between the drive rolls 511*a*, 512*a*, 521*a* and the idle rolls 511*b*, 512*b*, 521*b* confronting the drive rolls 511*a*, 512*a*, 521*a*, respectively.

The first nip roll set 511 of the first conveying unit 510 generates a larger nip force than the third nip roll set 512 of the first conveying unit 510 and the second nip roll set 521 of the second conveying unit 520. Further, the third nip roll set 512 of the first conveying unit 510 generates a larger nip force than the second nip roll set of the second conveying unit 520. The nip forces of the nip roll sets 511, 512, 521 may be appropriately determined by the elastic constant of the elastic bodies 516, 526 and/or the interference of the idle rolls 511*b*, 512*b*, 521*b* with the drive rolls 511*a*, 512*a*, 521*a*, respectively. In a specific embodiment, the nip force in the first nip roll set 511 of the first conveying unit 510 is set to 200 gf, the nip force in the third nip roll set 512 is set to 150 gf, and the nip force in the second nip roll set 521 of the second conveying unit 520 is set to 100 gf. Either of the left or right first nip roll set 511 which applies stronger compression force to the left or right edge of the conveyed sheet S than other nip roll sets 512, 521 generates a force acting against a downstream force by which the sheet S is obliquely directed with respect to the conveying direction. As a result, the oblique feed (skew) of the sheet S is corrected.

Figure 2:
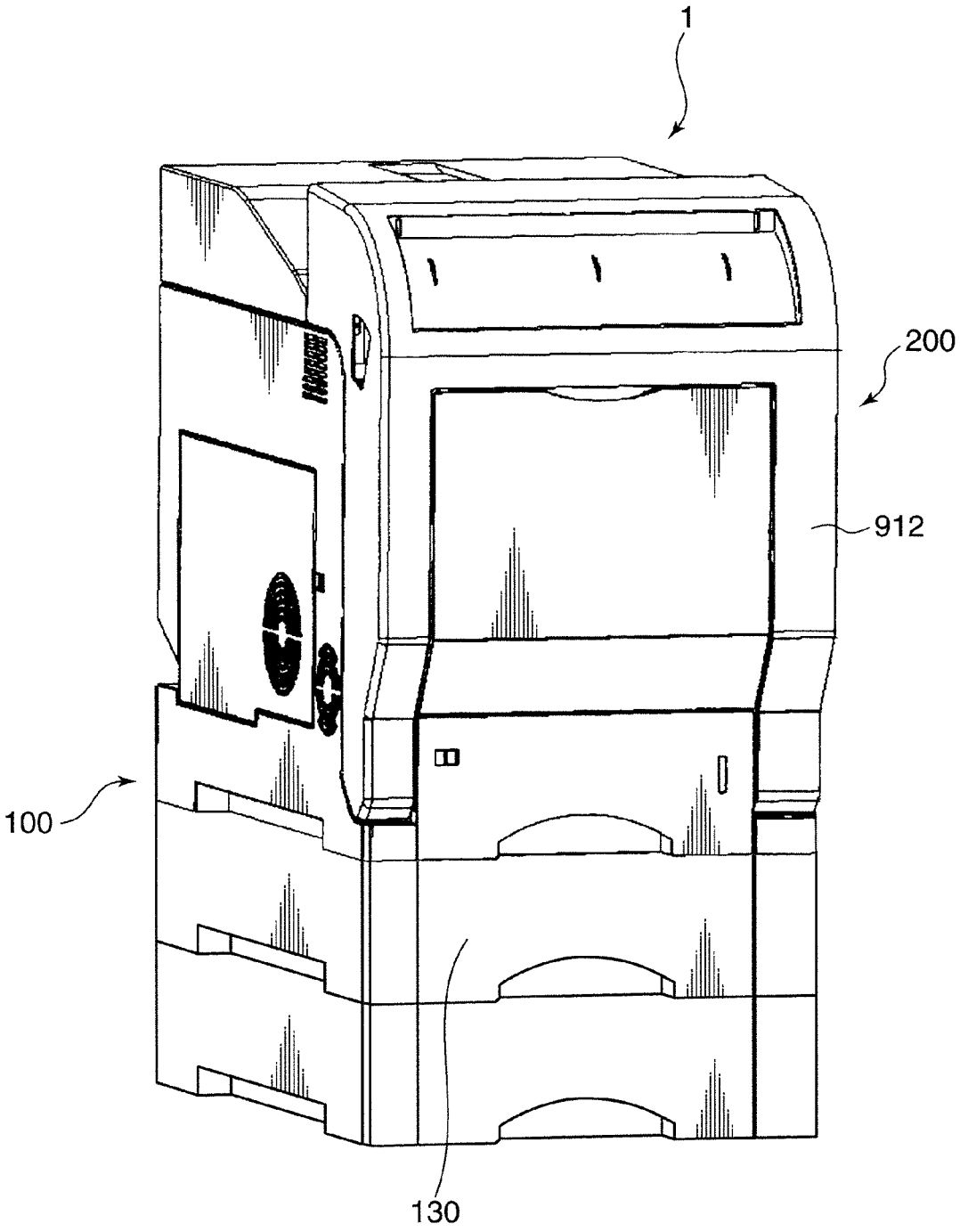
FIG. 2 is a perspective view of an image forming apparatus incorporating the principle of the conveyor shown in FIG. 1.

FIG. 2 is a perspective drawing of a color printer (image forming apparatus) incorporating the principle of the conveyor 500 described hereinabove with the context of FIG. 1A and FIG. 1B. The principle of the conveyor 500 described hereinabove in the context of FIG. 1A and FIG. 1B may be advantageously incorporated not only in the color printer shown in FIG. 2, but also in other image forming apparatuses such as a monochromatic printer, a facsimile and a copier.

A color printer 1 is provided with a printer main body 200 connected directly or via a LAN to a personal computer (not shown) and a feeder 100 below the printer main body 200. The feeder 100 is configured to adjustably accommodate various sizes of the sheets S. The color printer 1 may include other functional elements such as a control circuit configured to control the operation of the color printer 1, which are provided in a typical color printer.

Figure 3:
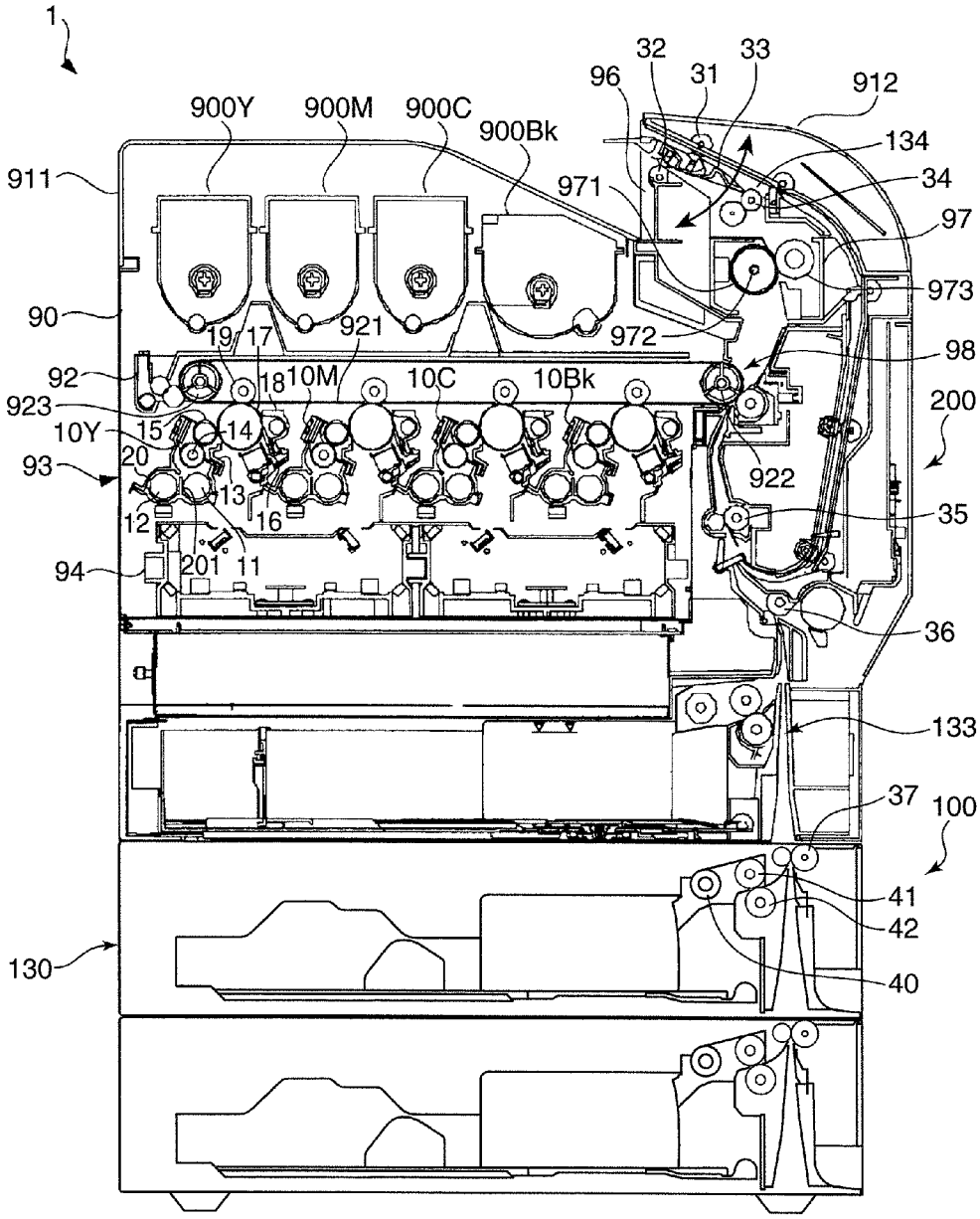
FIG. 3 schematically shows an internal structure of the image forming apparatus shown in FIG. 2.

FIG. 3 is a cross-sectional view schematically illustrating an internal structure of the color printer 1 shown in FIG. 2. The printer main body 200 is provided with toner containers 900Y, 900M, 900C, 900Bk, an intermediate transfer unit 92, an image forming unit 93, an exposure unit 94, a fixing unit 97, a discharge unit 96, a housing 90 of the printer main body 200, a top cover 911, and a front cover 912.

The image forming unit 93 is provided with the yellow toner container 900Y, the magenta toner container 900M, the cyan toner container 900C and the black toner container 900Bk. The image forming unit 93 includes developing units 10Y, 10M, 10C, 10K corresponding to YMCBk colors under these containers 900Y, 900M, 900C, 900Bk.

The image forming unit 93 includes photosensitive drums 17 configured to carry respective colors of toner images. A photosensitive drum using an amorphous silicon (a-Si) material may be used as the photosensitive drum 17. Yellow, magenta, cyan, and black toners are supplied from the corresponding toner containers 900Y, 900M, 900C, 900Bk to the respective photosensitive drums 17. The image forming unit 93 according to the present embodiment is configured to form a full color image, but such a configuration is not intended any limitation. Alternatively the image forming unit 93 may be also configured to form a black-and-white image and any color image other than the full color image.

A charging device 16, a developing device 10 (10Y, 10M, 10C, 10Bk), a transfer roll 19, and a cleaning device 18 are disposed around every photosensitive drum 17. The charging device uniformly charges a circumferential surface of the photosensitive drum 17. The charged surface of the photosensitive drum 17 is exposed by the exposure unit 94 to form a latent electrostatic image. Each of the developing devices 10Y, 10M, 10C, 10Bk develops (visualizes) the latent electrostatic image formed on each photosensitive drum 17 with the corresponding color of the toner supplied from each of toner containers 900Y, 900M, 900C, 900Bk. The transfer roller 19 configured to sandwich the intermediate transfer belt 921 with the photosensitive drum 17 forms a nip portion where the toner image on the photosensitive drum 17 is primarily transferred onto the intermediate transfer belt 921. The cleaning device 18 cleans the circumferential surface of the photosensitive drum 17 after the primary transfer of the toner image to the transfer belt 921.

The developing devices 10Y, 10M, 10C, 10Bk are provided with a housing 20. Two-component developer containing magnetic carrier and toner is accommodated inside the housing 20. The housing 20 is also provided with two stirring rollers 11, 12. The stirring rollers 11, 12 in the vicinity of the bottom portion of the housing 20 parallel extend in a direction of the left and right side of the color printer 1.

A circulation path of the developer is defined on the bottom inside the housing 20. The stirring rolls 11, 12 are installed inside the circulation path. A partition wall 201 vertically standing from the bottom portion of the housing 20 is provided between the stirring rolls 11, 12. The partition wall 201 extends in the same direction as the stirring rolls 11, 12. The partition wall 201 partitions the circulation path so that the circulation path surrounds the partition wall 201. The two-component developer moving along the circulation path is electrically charged while being stirred by the stirring rolls 11 and 12.

The two-component developer circulates inside the housing 20 while being stirred by the stirring rolls 11 and 12. After the toner is electrically charged, the two-component developer on the stirring roller 11 is attracted to an upper magnetic roll 14 and conveyed downstream. The attracted two-component developer forms a magnetic brush (not shown) on the magnetic roll 14. The magnetic brush of which layer thickness is controlled by a doctor blade 13 forms a toner layer according to a difference in potential between the magnetic roll 14 and the developing roll 15. The electrostatic latent image on the photosensitive drum 17 is developed by the toner layer on the developing roll 15.

The exposure unit 94 including various optical elements such as a light source, a polygon mirror, a reflecting mirror and a deflecting mirror forms an electrostatic latent image by irradiating the circumferential surface of the photosensitive drum 17 of each image forming unit 93 according to image data.

The intermediate transfer unit 92 includes the intermediate transfer belt 921, a drive roll 922 and an idle roll 923. The toner images from the plurality of the photosensitive drums 17 is applied to and overlapped each other on the intermediate transfer belt 921 into the full color image (primary transfer). The applied toner image is secondary transferred by a secondary transfer unit 98 on the sheet S fed from the feeder 100. The drive roll 922 with the idle roll 923 circumferentially drives the intermediate transfer belt 921. The drive roll 922 and the idle roll 923 are rotatably supported by the housing 90 of the color printer 1.

The fixing unit 97 performs a fixing processing with respect to the toner image on the sheet S after the secondary transfer of the toner image. The fixing unit 97 includes a fixing roll 971 incorporating a heat source 972 and a pressurizing roll 973 which defines a fixing nip portion together with the fixing roll 971. The sheet S subjected to the fixing processing is conveyed towards the discharge unit 96 formed in an upper portion of the printer main body 200.

The discharge unit 96 discharges the sheet S conveyed from the fixing unit 97 onto a top cover 911 used as a discharge tray.

The feeder 100 includes a multistage (three stages in the present embodiment) feed unit 130 (feed device) detachably coupled to the housing 90 of the printer main body 200, and a conveying path 133 configured to guide the sheet S in the feed units 130 towards the image forming unit 93. The feed unit 130 accommodates a sheet stack including a plurality of sheets S on which the images are to be formed, respectively. Various sizes of the sheet stacks may be stored in the stages of the feed units 130, respectively. In the selected feed unit 130, the uppermost sheet S in the sheet stack is picked up one by one with a driven pick-up roll 40 in the feed unit 130, fed to the conveying path 133, and introduced in the image forming unit 93.

Each feed unit 130 includes a conveying mechanism. If desired, a plurality of the feed units 130 may be stacked and fixed to the printer main body 200. When the feed units 130 are stacked below the printer main body 200, the conveying mechanisms of the feed units 130 coupled together may define a unified conveying path 133 extending to the printer main body 200. In the present embodiment, the feeder 100 includes three feed units 130. The number of the feed units 130 is not particularly limited. Therefore the feeder 100 may include one, two or four or more feed units 130.

The feed unit 130 includes a feed roll 41 on the downstream side of the pick-up roll 40 in the conveying direction and a break-off roll 42 below the feed roll 41. The feed roll 41 feeds the sheet S fed by the pick-up roll 40 to the conveying roller 37. The feed roll 41 rotates in a direction to convey the sheet S downstream whereas the break-off roll 42 rotates in the opposite direction so as to return the sheet S upstream. Even when the stacked sheets S are picked up by the pick-up roll 40, because of the break-off roll 42, the sheet S other than the uppermost sheet S is less likely to be fed toward the conveying roller 37 while only the uppermost sheet S is conveyed by the feed roll 41 to the conveying roller 37, which conveys the sheet S to the conveying path 133.

The printer main body 200 includes a conveying roller 36 to which the sheet S conveyed along the paper conveying path 133 reaches. The printer main body 200 also includes a resist roller 35 to which the conveying roller 36 conveys the sheet S.

The resist roller 35 corrects an oblique feed of the sheet S, and then conveys the sheet S to the secondary transfer unit 98 while adjusting the conveyance timing of the sheet S with a transfer timing of the image formed by the image forming unit 93. In the secondary transfer unit 98, the toner image primary transferred onto the intermediate transfer belt 921 is transferred onto one surface (first surface) of the sheet S (secondary transfer). The sheet S subjected to the secondary transfer is sent to the fixing unit 97. In the fixing unit 97, pressure and heat are applied to the toner image on the sheet S so that the toner is fixed to the sheet S.

A branch roller 34 is installed after the fixing unit 97. A diverter 33 installed after the branching roller 34 is a plate-like member with a distal end and a proximal end. The diverter 33 is rotated up-down with respect to the proximal end. The distal end of the diverter 33 is positioned in the vicinity of a nip between a pair of rolls included in the branching roller 34. When the distal end of the diverter 33 is in the upper position, the sheet S is guided by the lower surface of the diverter 33 to the discharge roll 32 in the discharge unit 96. When the distal end of the diverter 33 is in the lower position, the sheet S is guided by the upper surface of the diverter 33 and reaches a switchback roller 31 in the discharge unit 96. Therefore, the conveying route of the sheet S sent from the fixing unit 97 to the branching roller 34 changes correspondingly to the position of the diverter 33. When the diverter 33 is in the upper position, the sheet S is discharged by the discharge roll 32 onto the top cover 911.

When the diverter 33 is in the lower position, the sheet S is guided to the switchback roller 31, which then feeds out the sheet S guided by the diverter 33 to the top cover 911 by a predetermined length (discharge direction). The switchback roller 31 is then reversed so that the sheet S is pulled back into the printer main body 200 (duplexing direction).

The printer main body 200 includes a conveying path 134 directed to the switchback roller 31. The conveying path 134 is used for the sheet S to be printed on both sides. The aforementioned switchback roller 31, to which the diverter guides the sheet S, performs the switchback operation for the sheet S with the toner image fixed on one surface thereof by the fixing unit 97. The sheet S after the switchback operation moves inside the printer main body 200 along the conveying path 134.

The conveying path 134 extends downward along an arc inner surface of a front cover 912, and then directs to a upstream side of the resist roller 35 with drawing an arc with a central angle of about 180°. The conveying path 134 and the conveying route of the sheet S from the feed unit 130 to the resist roller 35 joins together at the upstream of the resist roller 35.

The sheet S conveyed to the outlet port of the conveying path 134 moves to the secondary transfer unit 98 via the resist roller 35. The surface (second surface opposite to the first surface) of the sheet S which does not bear the fixed toner image confronts the intermediate transfer belt 921 after the sheet S passes through the conveying path 134. Therefore, the toner images are formed on both sides of the sheet S passed through the secondary transfer unit 98. The sheet S provided with the toner images on both sides thereafter moves to the fixing unit 97 and is subjected to the fixing operation for the toner image. When the sheet S with the toner images fixed on both sides by the fixing unit 97 reaches the branching roller 34, the diverter 33 is controlled so that the distal end of the diverter 33 moves to the upper position. As a result, the sheet S passed the branching roller 34 is guided by the lower surface of the diverter 33 and moves to the discharge roll 32, which then discharges the sheet S printed on both sides on the top cover 911.

Figure 4:
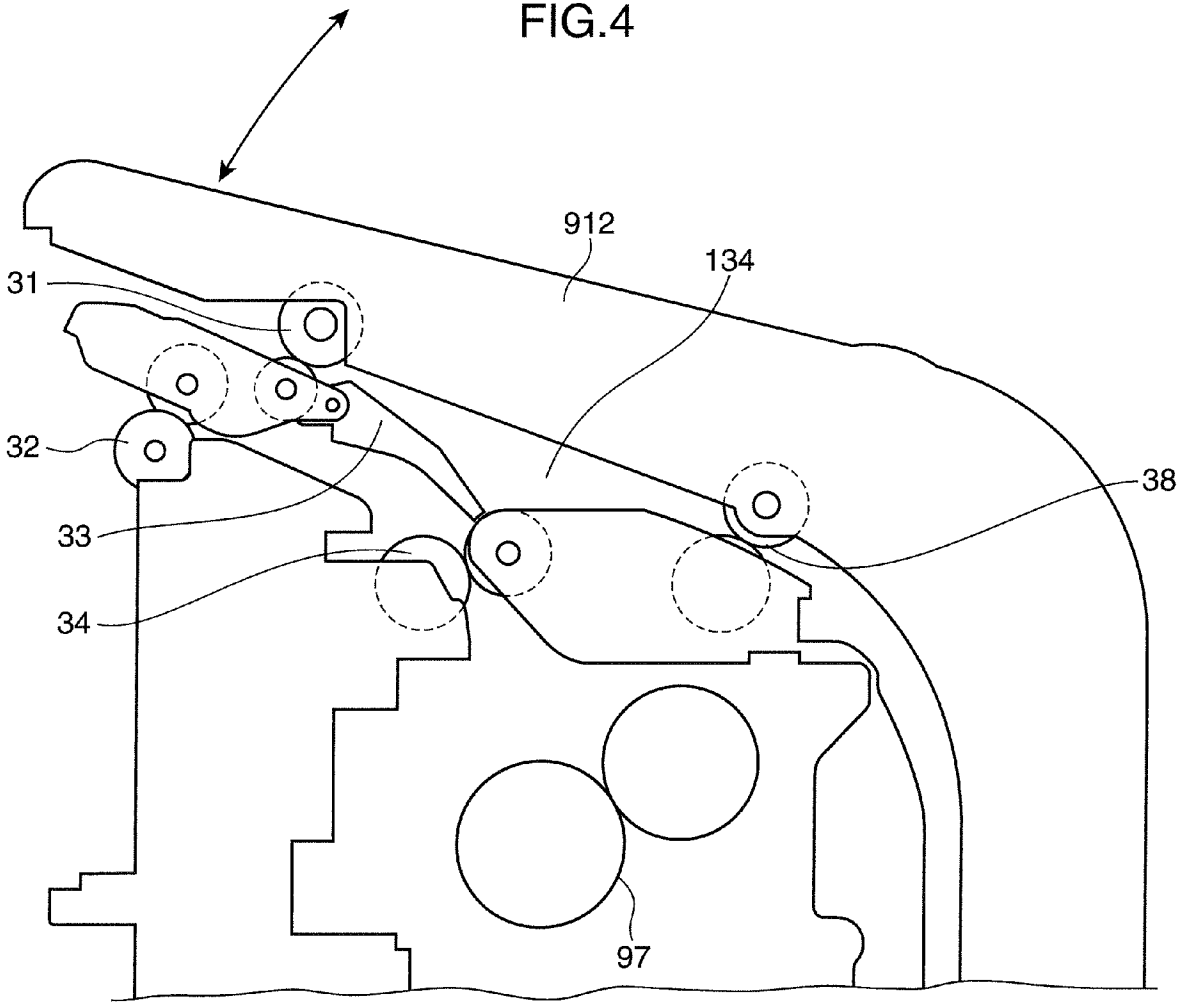
FIG. 4 is an enlarged view taken close to a switchback roller of the image forming apparatus shown in FIG. 3.

FIG. 4 is an enlarged view illustrating the structure of the color printer 1 (shown in FIG. 3) in the vicinity of the switchback roller 31. FIG. 4 shows parts of the fixing unit 97, the front cover 912, the branching roller 34, the diverter 33, the discharge roll 32 and the conveying path 134 described above in the context of FIG. 3. In FIG. 4, the conveying roller 38 is shown on the downstream side of the switchback roller 31 in the conveying path 134. The principle of the conveyor 500 described in the context of FIG. 1A and FIG. 1B is applied to the color printer 1 described in the context of FIG. 2 to FIG. 4 by using the first conveying unit 510 as the switchback roller 31 and using the second conveying unit 520 as the conveying roller 38. As shown in FIG. 4, the front cover 912 may rotate to the front surface side and back surface side of the color printer 1 with respect to the proximal end at the bottom portion of the printer main body 200 (see FIG. 2). The support shaft for an upper roll of the conveying roller 38 is rotatably attached to the front cover 912 with which the support shaft rotatably moves together. Meanwhile, the support shaft for the switchback roller 31 and the support shaft for a lower roll of the conveying roller 38 are not connected to the front cover 912.

Figure 5:
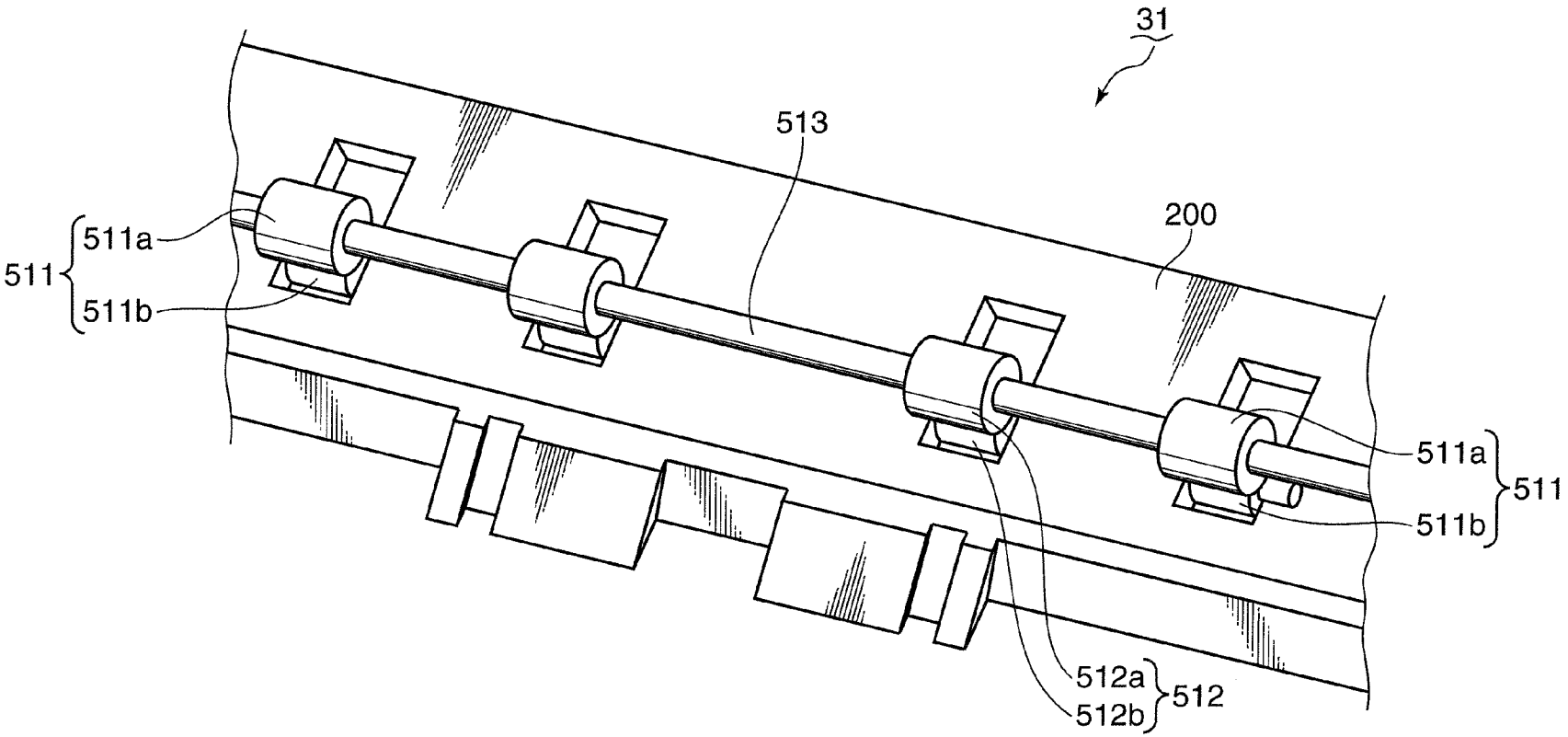
FIG. 5 is an enlarged perspective view of the switchback roller shown in FIG. 4.

FIG. 5 is an enlarged perspective view of the attachment portion of the switchback roller 31 while the front cover 912 is removed. The switchback roller 31 is provided with a pair of the first nip roll sets 511 disposed on the left and right sides and a pair of the third nip roll sets 512 disposed between the left and right first nip roll sets 511. The upper rolls of the first nip roll sets 511 and the third nip roll sets 512 are worked as the drive rolls 511*a*, 512*a*. These drive rolls 511*a*, 512*a* are connected to each other by the shaft 513. A motor configured to bi-directionally rotate is connected to one end of the shaft 513. A spacing between the left and right first nip roll sets 511 and a spacing between the pair of the third nip roll sets 512 may be determined correspondingly to a width of the sheet S accommodated in the feed unit 130 of the color printer 1. For example, the spacing between the left and right first nip roll sets 511 is determined such that when the widest sheet S reaches the switchback roller 31, the first nip roll sets 511 come into contact with the left and right edges of the widest sheet S or the vicinity thereof. The spacing between the pair of the third nip roll sets 512 is determined such that when the narrowest sheet S reaches the switchback roller 31, the third nip roll sets 512 come into contact with the left and right edges of the narrowest sheet S or the vicinity thereof.

The idle rolls 511*b*, 512*b* are disposed below the drive rolls 511*a*, 512*a*, respectively. The idle rolls 511*b*, 512*b* are partially embedded in the housing of the printer main body 200.

The support shafts of the idle rolls 511*b*, 512*b* are attached to the housing wall of the printer main body 200.

Figure 6A:
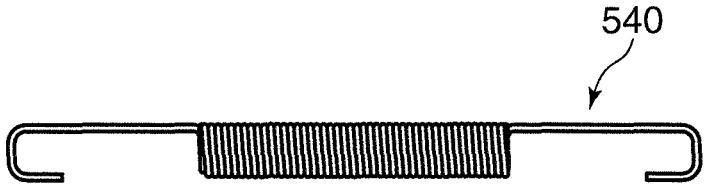
FIG. 6A shows a support structure of an idle roll of the switchback roller shown in FIG. 5.
Figure 6B:
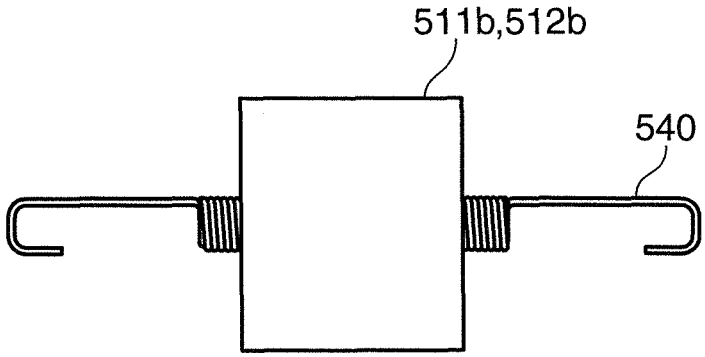
FIG. 6B shows a support structure of an idle roll of the switchback roller shown in FIG. 5.

FIG. 6A and FIG. 6B show the support shafts of the idle rolls 511*b*, 512*b*. FIG. 6A shows the shaft by itself, and FIG. 6B shows the support shaft assembled with the idle roll 511*b* or 512*b*. The support shafts of the idle rolls 511*b*, 512*b* may include coil springs 540. Both ends of the coil spring 540 are substantially bent into a U-shape. The portions substantially bent into the U-shape may be engaged with protrusions formed in the housing of the printer main body 200. The central coiled portion of the coil spring 540 extending through the idle rolls 511*b*, 512*b* along their rotation central axes elastically and rotatably supports the idle rolls 511*b*, 512*b*.

Figure 7:
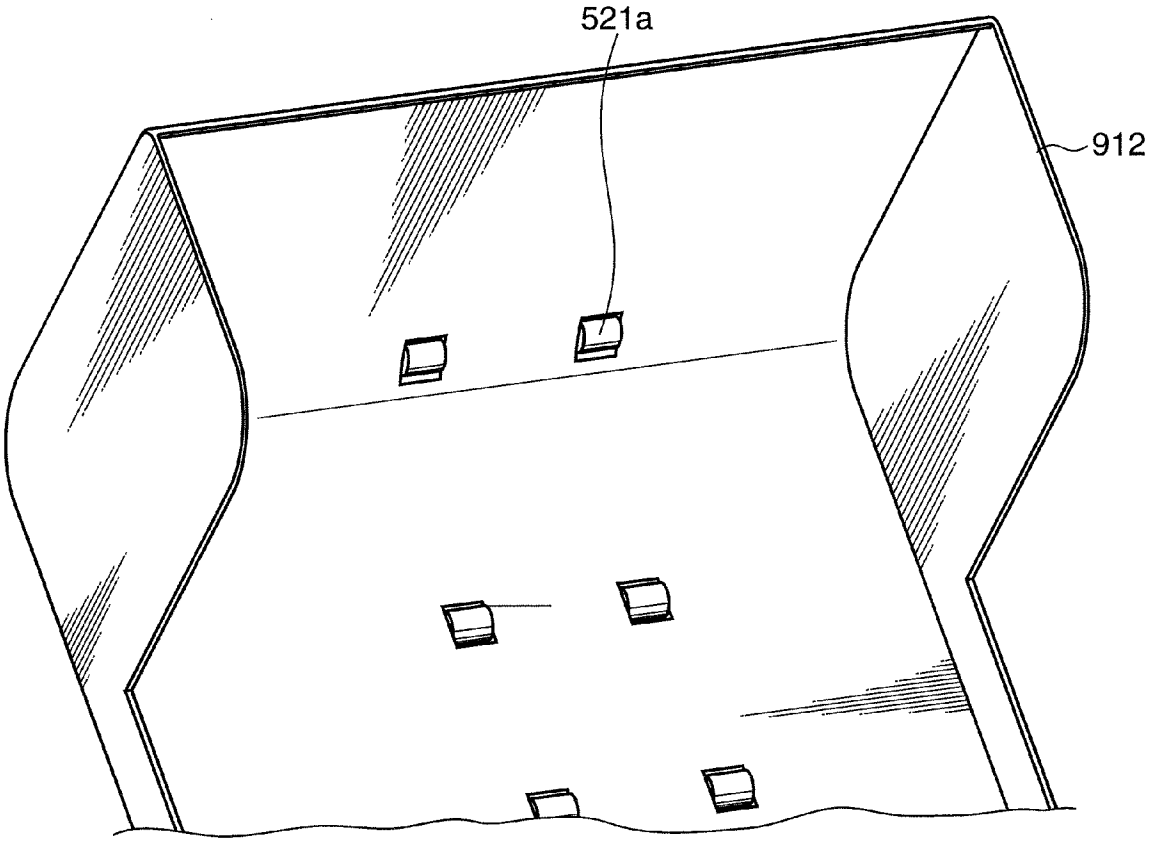
FIG. 7 is a perspective view illustrating the inner surface of a front cover of the image forming apparatus shown in FIG. 3.

FIG. 7 is a perspective view showing the inner surface of the front cover 912 rotated to be apart from the printer main body 200. A plurality of conveying rolls are aligned from the distal end to the proximal end of the front cover 912 along its inner surface. Among the plurality of the conveying rolls, the roller 521*a* which is the closest to the distal end of the front cover 912 is the conveying roller 38 used as the second conveying unit 520 described in the context of FIG. 1A and FIG. 1B. The roll 521*a* is partially embedded in the inner surface of the front cover 912.

Figure 8A:
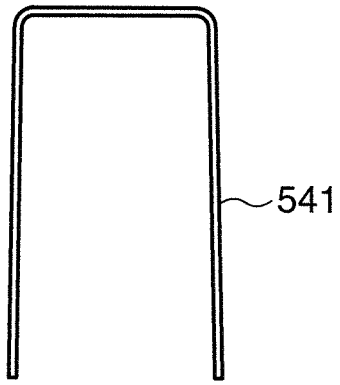
FIG. 8A shows a support structure of the conveying roller (upper side) shown in FIG. 7.
Figure 8B:
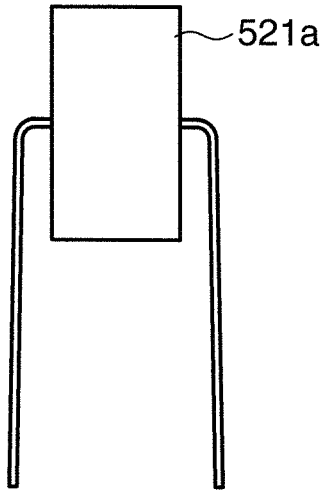
FIG. 8B shows a support structure of the conveying roller (upper side) shown in FIG. 7.

FIG. 8A and FIG. 8B show the support shaft structure of the roll 521*a* shown in FIG. 7. FIG. 8A shows the support shaft of the roll 521*a* by itself, and FIG. 8B shows the support shaft assembled with the roll 521*a*. The support shaft 541 for the roll 521*a* may be made from a metal wire, which is inserted into the roll 521*a* along its rotation center axis, substantially formed into a U-shape. Both ends of the support shaft 541 are inserted and fixed inside the front cover 912 by an appropriate method. The metal wire (second shaft) in the central region of the support shaft 541 between the bent portions rotatably supports the roll 521*a*.

Figure 9:
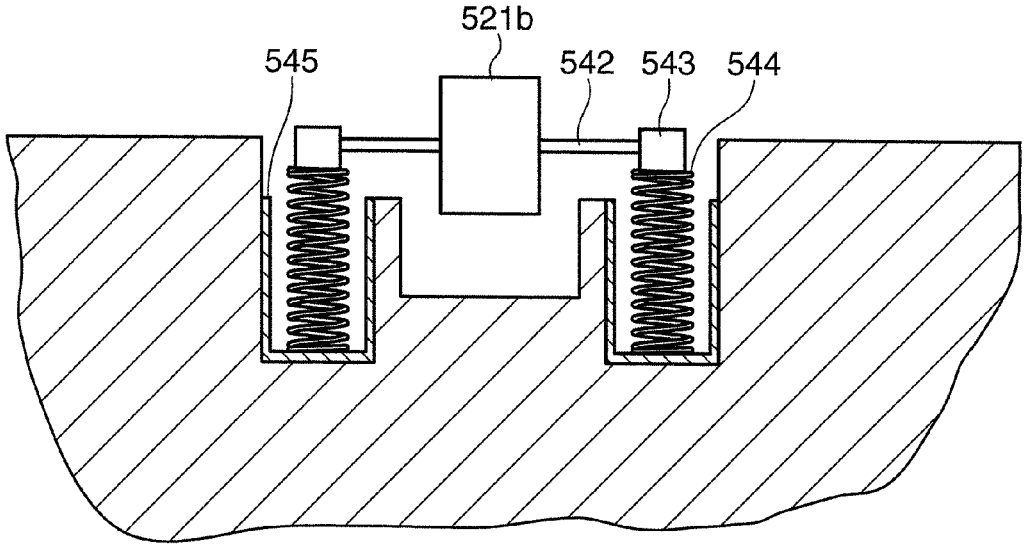
FIG. 9 is a schematic drawing showing a support structure of the conveying roller (lower side) facing the conveying roller shown in FIG. 7.

FIG. 9 schematically shows the support structure of the roll 521*b* confronting and coming into contact with the roll 521*a* after the front cover 912 rotates to a closer position to the printer main body 200. The roll 521*b* is rotatably supported for example, by a metal wire shaft (third shaft) 542. Both ends of the metal wire shaft 542 are connected to a support block 543 which is supported from below by a coil spring (elastic member) 544. The coil spring 544 may be accommodated in a cylinder bracket 545 embedded in the housing of the printer body 200. With such a structure, the roll 521*b* may be elastically supported.

Figure 10B:
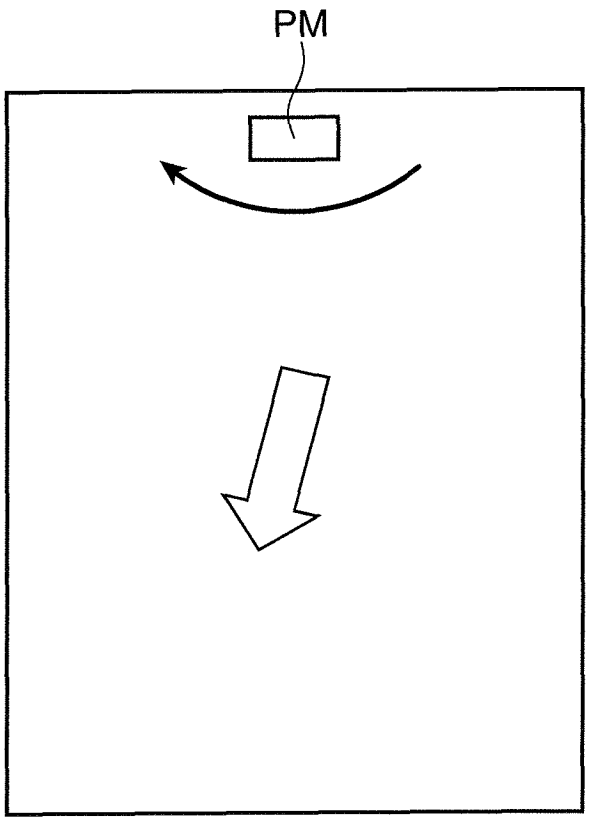
FIG. 10B is a model diagram illustrating a principle of inhibiting the oblique feed of the sheet in one embodiment of the present invention.
Figure 10A:
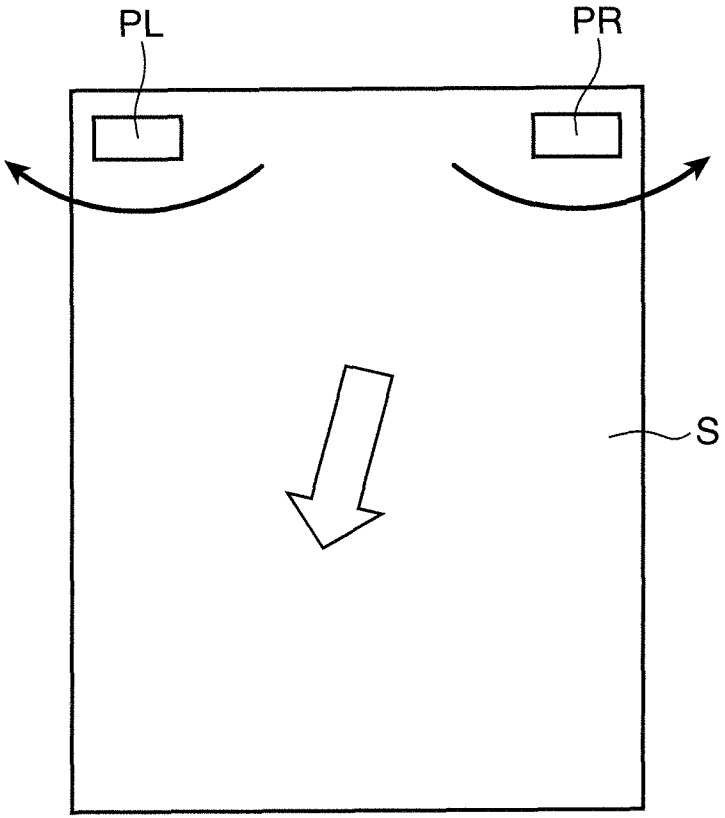
FIG. 10A is a model diagram illustrating a principle of inhibiting the oblique feed of the sheet in one embodiment of the present invention.

FIG. 10A is a model diagram illustrating a dynamics structure to apply the strongest nip force to the left and right edges of the sheet S according to the above-described embodiment. FIG. 10B is a model diagram illustrating a dynamics structure to apply the strongest nip force in the central position in the transverse direction of the sheet S. If the strongest nip force is applied to the left and right ends of the sheet S, and for example if the sheet S advances with inclination to the left, a clockwise momentum is generated about a force point PL positioned on the left side and a counterclockwise momentum is generated about a force point PR positioned on the right side. As a result, the oblique advance of the sheet S is inhibited. In particular, when the principle according to the present embodiment is applied to the switchback conveying mechanism for the sheet S of the image forming apparatus 1 described in the context of FIG. 2 to FIG. 9 (for example, when rotation inertia resistance of the left or right roll 521*a* of the conveying roller 38 after the switchback roller 31 is larger than the rotation inertia resistance of the right or left roll 521*a*), the sheet S is likely to obliquely move after temporal stop. However, the first nip roll set 511 used as the switchback roller 31 may correct the oblique movement of the sheet S to be sent. When one force point PM is disposed in the central position in the transverse direction of the sheet S as shown in FIG. 10B, if the sheet S advances obliquely to the left, there is no factor canceling the momentum generated around the force point PM so that the oblique advance of the sheet S is less likely to be corrected.

In the present embodiment, the drive source configured to rotate the first nip roll set 511 is commonly used to drive the second nip roll set 521. Alternatively, the first nip roll set 511 and the second nip roll set 521 may be driven with different drive sources.

In the above-described embodiment, the rolls in the first conveying unit 510 and the second conveying unit 520 are made from rubber. Alternatively the rolls may also be made from other materials suitable for conveying the sheet S.

A conveyor according to one aspect of the above-described embodiment includes a first conveying unit including a pair of first nip roll sets configured to nip and convey the sheet, and a second conveying unit including a second nip roll set configured to nip and convey the sheet from the first conveying unit, wherein the second nip roll set nips the sheet at an inner location of the sheet than the first nip roll set, and the first nip roll set nips the sheet more strongly than the second nip roll set.

According the above configuration, the first conveying unit nips an outer location of the sheet more strongly than the downstream second conveying unit. As a result, the first conveying unit works against a momentum causing the oblique feed of the sheet, which is thus reduced.

In the above-described configuration, it is preferred that the first conveying unit includes a third nip roll set between the pair of the first nip roll sets.

According to the configuration, the third nip roll set may convey a narrower sheet than spacing between the pair of the first nip roll sets. A plurality of the third nip roll sets may be provided between the pair of the first nip roll sets. Spacing between the third nip roll sets may be determined so that the third nip roll sets nip the narrowest sheet among a various width of sheets to pass the first conveying unit. The third nip roll sets preferably nip the edge portions of the narrowest sheet (edge portions parallel to the conveying direction of the sheet).

In the above-described configuration, it is preferred that the first nip roll nips the sheet more strongly than the third nip roll set.

According to the above configuration, the first nip roll set primarily works for correcting the conveying direction of the sheet.

In the above-described configuration, it is preferred that the third nip roll nips the sheet more strongly than the second nip roll set.

According to the above configuration, the third nip roll set positioned on the upstream side in the conveying direction acts against factors causing the oblique feed on the downstream side.

In the above-described configuration, it is preferred that the first conveying unit include a first shaft, a first roll and a second roll attached to the first shaft with a predetermined spacing, and a third roll confronting the first roll, and a fourth roll confronting the second roll, and one of the pair of the first nip roll sets includes the first roll and the third roll, and another of the pair of the first nip roll sets includes the second roll and the fourth roll.

According to the above configuration, the sheet is nipped and conveyed between the first roll and the third roll and the between the second roll and the fourth roll.

In the above-described configuration, it is preferred that the first conveying unit further includes a drive source configured to drive the first shaft.

According to the above configuration, the first shaft is driven by the drive source, so that the sheet is conveyed.

In the above-described configuration, it is preferred that the drive source bi-directionally rotates the first shaft.

According to the above configuration, the sheet may be subjected to a switch back conveyance.

In the above-described configuration, it is preferred that the first conveying unit further includes a coil spring extending along a rotation center axis of at least one of the third roll and the fourth roll, and the coil spring rotatably supports the at least one of the third roll and the fourth roll.

According to the above configuration, the nip force between the first nip roll sets may be increased or decreased by replacing one coil spring with another coil spring with a spring constant different from that of the one coil spring. The elastic support structures of the rolls in the first conveying unit and the second conveying unit may be equivalent or different.

In the above-described configuration, it is preferred that the second nip roll set includes a fifth roll, a sixth roll confronting the fifth roll, a second shaft extending along a rotational center axis of the fifth roll and rotatably supporting the fifth roll, a third shaft rotatably supporting the sixth roll, and an elastic member configured to support the third shaft.

According to the above configuration, the sheet is nipped and conveyed between the fifth roll and the sixth roll.

An image forming apparatus according to one aspect of the above-described embodiment includes a resist roller configured to send the sheet including a first surface and a second surface opposite to the first surface downstream at a predetermined timing, a transfer unit configured to transfer a toner image onto the first surface of the sheet sent from the resist roller, a fixing unit configured to fix the toner image formed on the first surface of the sheet sent from the transfer unit, and the above-mentioned conveyor; wherein a first conveying unit is configured to convey the sheet sent from the fixing unit in a discharge direction to discharge the sheet or in a duplexing direction to send the sheet to a conveying path for transferring and the fixing a toner image on the second surface; and a second conveying unit is provided in the conveying path.

According to the above configuration, the first conveying unit nips an outer location of the sheet more strongly than the downstream second conveying unit. As a result, the first conveying unit works against a momentum causing the oblique feed of the sheet, which is thus reduced.

This application is based on Japanese Patent application serial No. 2009-145389 filed in Japan Patent Office on Jun. 18, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A conveyor configured to convey a sheet, comprising:

a sheet conveying path extending in a first direction;

a first conveying unit disposed at a first position along the sheet conveying path, and including a first shaft, first and second rolls attached to the first shaft and spaced from one another by a predetermined roll distance in a second direction perpendicular to the first direction, third and forth rolls confronting the first and second rolls respectively to define two first nip roll sets nipping the sheet and conveying the sheet in the first direction, and first elastic bodies that give the first nip roll sets first nip forces that are applied to the sheet; and a second conveying unit disposed at a second position downstream from the first position along the sheet conveying path, and including a second shaft, fifth rolls attached to the second shaft and sixth rolls confronting the respective fifth rolls to define second nip roll sets that nip and convey the sheet in the first direction, the second nip roll sets being disposed so that every second nip roll set of the second conveying unit is at a position in the second direction inward of the two first nip roll sets of the first conveying unit so that the second nip roll set is arranged within an area corresponding to the roll distance of the first nip roll set, and a second elastic body that gives the second nip roll sets a second nip force that is applied to the sheet;

a belt connecting the first shaft and the second shaft; and a drive source delivering a driving force to the belt so that the driving force of the drive source is transmitted simultaneously to the first and second shafts, wherein the first conveying unit feeds the sheet at a feed rate faster than a feed rate by the second conveying unit, each of the first nip forces is stronger than the second nip force and is applied to a region of the sheet outward of the second conveying unit in the second direction and while the second conveying unit is applying the second nip force to a downstream part of the sheet so that a skew of the sheet at the second conveying unit is prevented by the first conveying unit.

2. The conveyor according to claim 1, wherein the first conveying unit includes a third nip roll set within the roll distance of the first nip roll sets.

3. The conveyor according to claim 2, wherein the first conveying unit includes a third elastic body that gives the third nip roll set a third nip force that is applied to the sheet; and each of the first nip forces is stronger than the third nip force.

4. The conveyor according to claim 3, wherein the third nip force is stronger than the second nip force.

5. The conveyor according to claim 1, wherein the drive source bi-directionally rotates the first shaft and the second shaft.

6. The conveyor according to claim 1, wherein the first elastic bodies include a coil spring extending along a rotational center axis of at least one of the third roll and the fourth roll, and the coil spring rotatably supports the at least one of the third roll and the fourth roll.

7. The conveyor according to claim 1, wherein the second nip roll set includes:

a third shaft configured to rotatably support the sixth rolls; and an elastic member configured to support the third shaft.

8. An image forming apparatus configured to form an image on a sheet including a first surface and a second surface opposite to the first surface, comprising:

a resist roller configured to send the sheet downstream at a predetermined timing;

a transfer unit configured to transfer a toner image onto the first surface of the sheet sent from the resist roller;

a fixing unit configured to fix the toner image formed on the first surface of the sheet sent from the transfer unit; and the conveyor according to claim 1; wherein the first conveying unit is configured to convey the sheet sent from the fixing unit in a discharge direction to discharge the sheet or in a duplexing direction to send the sheet to a conveying path for transferring and fixing a toner image on the second surface; and the second conveying unit is provided in the conveying path.

* * * * *